United States Patent [19]

Grönblad

[11] 3,958,648

[45] May 25, 1976

[54] DRILLING EQUIPMENT

[75] Inventor: Sven Göran Anders Grönblad, Vastra Frolunda, Sweden

[73] Assignee: BPA Byggproduktion AB, Goteborg, Sweden

[22] Filed: Feb. 13, 1975

[21] Appl. No.: 549,555

[30] Foreign Application Priority Data

Feb. 18, 1974 Sweden ..... 7402091
Feb. 18, 1974 Sweden ..... 7402089

[52] U.S. Cl. ..... 175/21; 175/23; 175/171; 175/318

[51] Int. Cl.[2] ..... E21B 33/04; E21B 11/02

[58] Field of Search ..... 175/62, 171, 173, 207, 175/210, 212, 317, 318, 320, 259, 257, 258, 260, 261, 21, 22, 23; 166/196

[56] References Cited

UNITED STATES PATENTS

| | | | |
|---|---|---|---|
| 672,097 | 4/1901 | Eastman | 175/318 X |
| 999,000 | 7/1911 | Trippe | 166/196 X |
| 2,475,429 | 7/1949 | Humason | 175/318 X |
| 2,641,444 | 6/1953 | Moon | 175/171 X |
| 2,670,180 | 2/1954 | Ranney | 175/62 X |
| 2,784,942 | 3/1957 | Peck et al. | 175/171 |
| 3,115,755 | 12/1963 | Siebenhausen | 175/171 X |
| 3,390,730 | 7/1968 | Techy et al. | 175/171 |
| 3,605,922 | 9/1971 | Bergeron et al. | 175/210 |
| 3,656,564 | 4/1972 | Brown | 175/261 X |
| 3,732,143 | 5/1973 | Joosse | 175/171 X |

*Primary Examiner*—James A. Leppink
*Attorney, Agent, or Firm*—Harness, Dickey & Pierce

[57] ABSTRACT

Improved sealing means in rock drilling equipment of the kind comprising casing sections positioned between the drilling unit and the cutter head and housing the drill rod sections. A combined seal consisting of a metal part and a resilient part is positioned between the casing and the cutter head to prevent water and mud from penetrating into the casing. In addition, sealing means are provided to prevent drill water from flowing between the drill rod and the casing in the direction towards the drill chamber, and further means are provided to close off communication between the drill chamber and the annular chamber between the casing and the drill hole wall.

6 Claims, 5 Drawing Figures

DRILLING EQUIPMENT

BACKGROUND OF THE INVENTION

The present invention concerns improvements in drilling equipment for use in horizontal drilling through rocks into strata of earth and sand.

Drilling of this kind below ground level is carried out for insertion of pipes for various purposes. Before blasting of tunnels, pipes thus are inserted into holes drilled one adjacent the other in the rock in an annular shape, to serve as casings for refrigerating pipes. The latter in turn serve the purpose of creating an artificial frost mass in the soil about the strata of earth that are later to be blasted away. The frost soil mass thus created in an artificial manner prevents water from flowing into the excavated tunnel, which saves times and effort.

Drilling equipment for use in such horizontal drilling operations comprises a drilling unit, said casing sections, a cutter head disposed at the forward end of the foremost casing as seen in the drilling direction, and drill rod sections which extend through the casing sections between the drilling aggregate and the cutter head and which are provided with an axial through channel feeding drill water to the cutter head.

The drilling operations involve several problems, however, particularly when the cutter head penetrates through rock into strata of earth and sand. If the air pressure inside the casing sections and the water pressure in the cutter head drill water channels are lower than the external ground water pressure, water and earth material will penetrate into said casing sections and channels all the way up to the drilling chamber. These displacements of material will in turn give rise to subsidence above the drilling space. In addition, material displacements also increase the risks of deviations from the intended drilling direction.

One has tried to eliminate this problem by using a cutter head, the diameter of which somewhat exceeds the internal diameter of the adjacent casing and which is mounted so as to close the forward casing end. Although this had a positive effect and partly prevented earth, sand, and water from penetrating, some other disadvantages arose in its stead. For instance, a cutter head of this size cannot be retrieved through the casing and used again. If, in addition, one fails to loosen the drill rod sections from the cutter head after completion of the drilling operation, which is not unusual, the drill hole cannot be used and a new hole must be started.

It is also possible to increase the air pressure inside the drill chamber for the purpose of preventing penetration of earth and water into the casing sections. However, this entails safety risks for the workmen and it is necessary to construct a sluice at the drill chamber entrance, which makes all transports to and from the drill chamber difficult and in addition time-consuming and expensive.

During the drilling operation the casing sections keep pace with the successive advancement of the cutter head through the strata of rock and earth. In rock drilling water does, however, seep into the drill hole also at the outside of these casing sections and flows into the drill chamber. When the cutter head reaches less compact strata of earth, the water is mixed with earth and sand, which aggravates the situation.

Attempts have been made to solve this problem by applying a seal in the form of an O-ring or a V-packing between the casing and the drill hole walls. These seals are, however, difficult to secure because of the movement of the casing in the working direction of the cutter head, and consequently the sealing effect is poor. On the other hand, if one succeeds in obtaining a comparatively good sealing effect, one instead has to face the disadvantage of accummulation of earth and sand forming plugs in front of the seal, which cause the casings to stick. In severe cases it might be necessary to drill a new hole for the casing adjacent the stuck one.

SUMMARY OF THE INVENTION

The present invention substantially eliminates the problems described above and this through very simple means. The invention is characterised by a combination of a metal seal and a seal consisting of a softer material, preferably rubber or plastics, these seals being positioned adjacent one another between the casing and the cutter head and arranged for cooperation to prevent ground level water and mud from entering into the casing.

In accordance with another characteristic of the present invention the drill rod positioned just behind the cutter head is provided with a one way valve arranged in the drill water channel and formed in a manner known per se by a valve ball arranged to be pressed against a valve seat by means of a compression spring.

Usually, this foremost drill rod has a drill water opening just behind the cutter head. In accordance with a further characteristic of the invention a seal is arranged behind this opening for the purpose of preventing drill water from flowing between the drill rod and the casing in the direction towards the drill chamber.

Through these means penetration of mud between casing and drill rod sections as well as into the drill water channels is efficiently prevented. When the drill fluid in these channels is cut off during the operation of jointing the drill rod sections, the one way valve positioned in the front drill rod will rapidly close the channel thereof, and consequently it becomes possible to work without impediments to connect a new drill rod.

An extra advantage gained with the combined seals is that it no longer is necessary to use a cutter head of the kind described above but instead an eccentric cutter head may be used which may be retrieved and thus re-used over and over again.

To prevent also penetration into the drill chamber of water and mud at the outside of the casing a pressure sleeve is arranged in accordance with the invention between the casing and the drill hole walls, said sleeve arranged to close off communication between the drill chamber and the annular channel existing between this casing and the drill hole wall, and into this annular channel debouches a conduit for supply of pressurized air or water.

In accordance with a preferred embodiment this pressure sleeve consists of an expansion ring arranged between two clamping rings and through which pass threaded bolts which likewise pass through an anchoring ring abutting against the drill chamber wall around the drill hole mouth, in addition to which between this anchoring ring and the adjacent clamping ring a distance sleeve is provided on each bolt. In this embodiment preferably at least one of the bolts is provided with a through channel to which may be connected the pressurized water or air supply conduit.

Owing to the pressure sleeve in accordance with the invention it is possible to apply a positive pressure to the external face about the casing. It is also possible to supply water from the drill chamber thereto. In this manner are eliminated the inconveniences of ground water penetration to the drill chamber resulting in material displacements in the less compact soil strata and subsidence therein, which would make drilling in the correct direction more difficult. At the same time advancement of the casing sections is facilitated because the latter slide forwards with less friction.

BRIEF DESCRIPTION OF THE DRAWINGS

The invention will be described more in detail in the following with reference to the accompanying drawings, wherein.

DETAILED DESCRIPTION OF PREFERRED EMBODIMENTS

Figure 1:
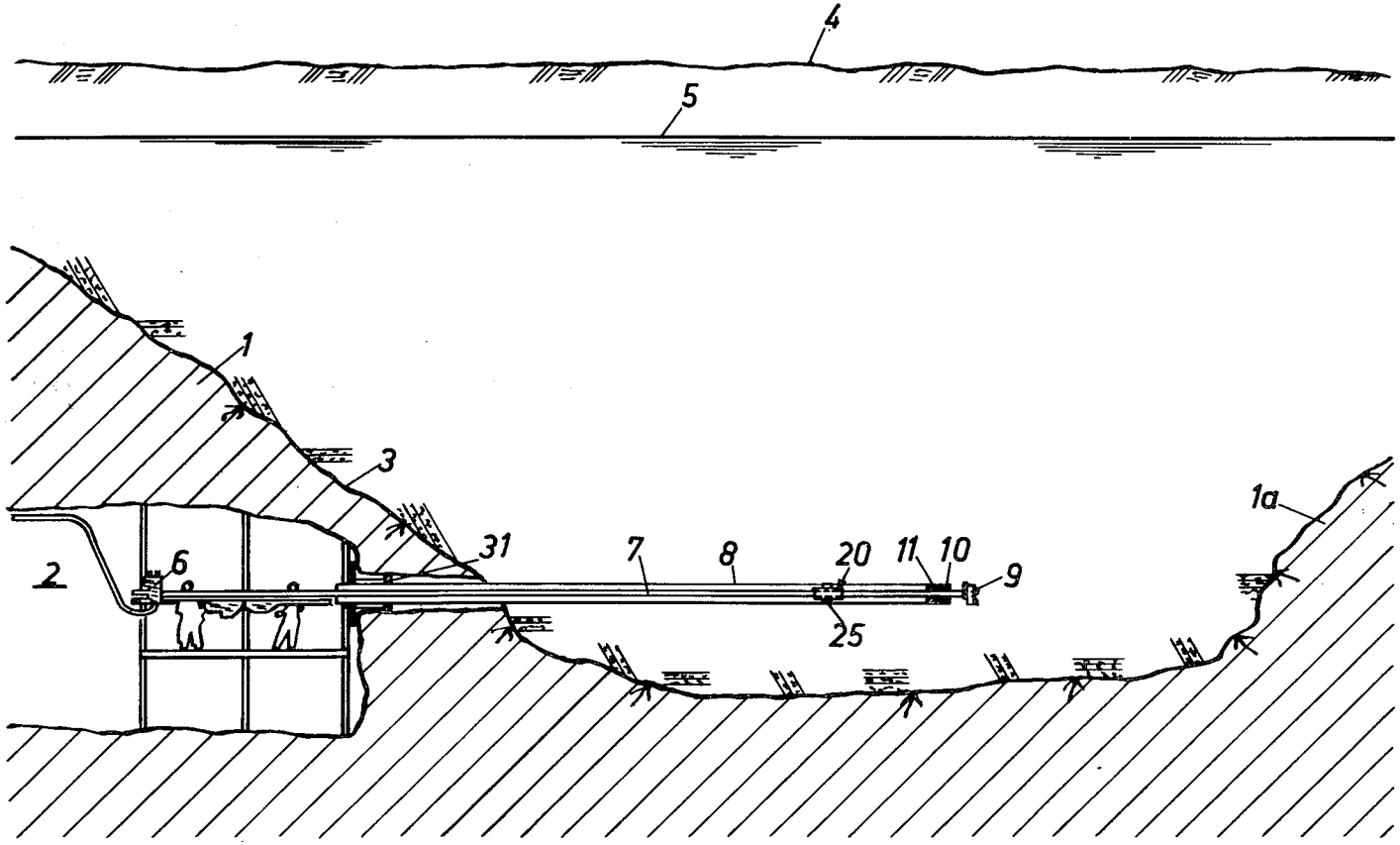
FIG. 1 is a schematically illustrated general arrangement plan of a drilling installation for performance of drilling with the use of casing sections.

The working enviroment is illustrated in FIG. 1. In a rock 1 below ground a drill chamber 2 has been blasted so as to extend close to a slope 3 of the rock. The purpose is to drill from this position a row of bores, one adjacent the other in an annular shape, through the rock wall 3 in a horizontal direction through less compact strata of earth consisting of soil, sand, clay and water, the ground level having been designated 4 and the ground water level 5, and into another rock ridge 1a positioned below ground. Casing sections 8 are arranged concentrically about the drill rod sections 7 of the drilling unit 6 so as to advance together with the cutter head 9 when the latter works itself successively forwards through the strata of earth.

Figure 2:
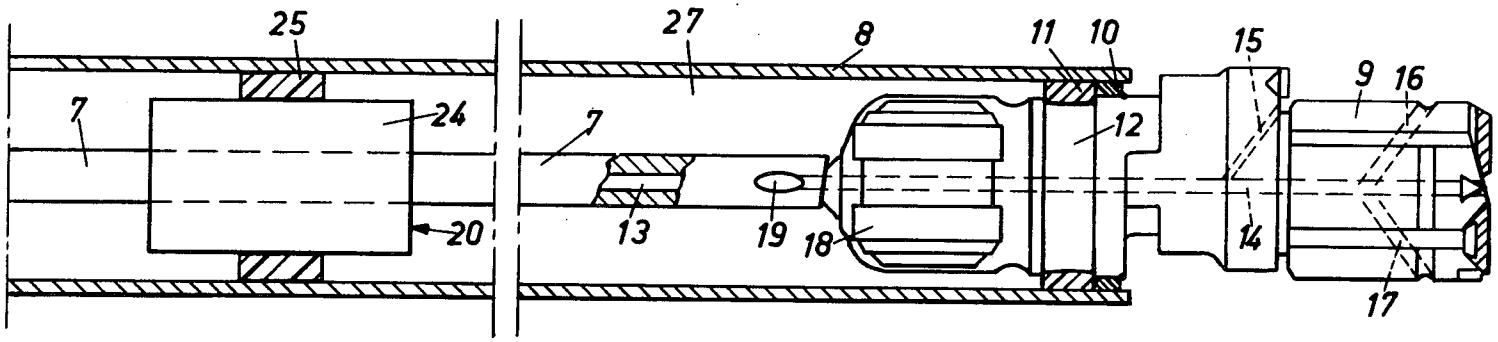
FIG. 2 is a vertical section through a casing with a cutter head arranged at the outer casing end.

As appears from FIG. 2, between the casing 8 closest to the cutter head 9 and the cutter head itself are arranged two seals positioned adjacent one another one outer metal seal 10 and an inner seal 11 of a softer material, preferably hard rubber or plastics. The metal seal 10 preferably is in the form of a hard-welding bead applied about the cutter head 9, the upper surface of the welding bead having been ground even and having a thickness calculated so as to make the welding bead fit well into the casing 8. The welding bead also serves to center and guide the cutter head 9 inside the casing 8. The softer seal 11 is preferably vulcanized to the cutter 9 in a peripheral groove 12 formed in the cutter head.

These two seals 10 and 11 provide, in combination, an extremely good sealing effect and prevent to a considerably high degree penetration of both coarser and finer particles and water into the casing. The combined effect of the seals also helps in slowing up wear compared to what would otherwise have been the case, had one used either a metal seal or a soft seal only.

Figure 3:
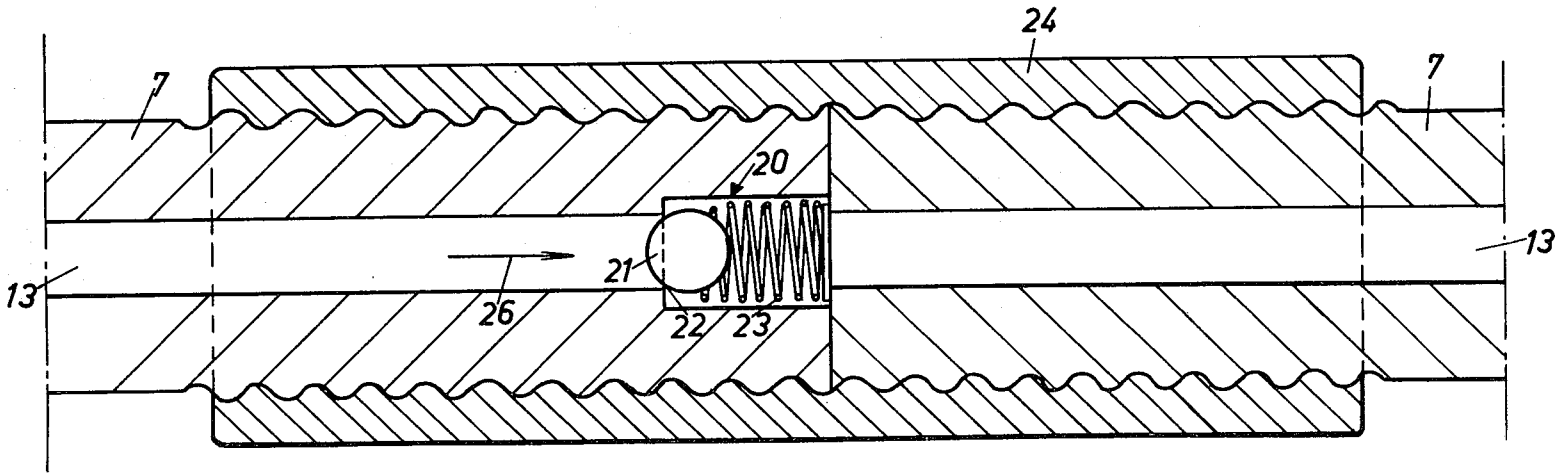
FIG. 3 is a vertical section, shown on an enlarged scale, through a drill rod including a one way valve in the rod drill water channel in accordance with the invention.

The drill rod 7 is provided with a drill water channel 13 merging into a channel 14 passing through the cutter head 9, this channel 14 dividing into channel arms 15, 16, and 17. At its rear, the cutter head 9 is provided with a cleaning device 18. At its forward end, the drill rod 7 is provided with a drill water opening 19. Further to the rear in the joint between two drill rod sections 7 is provided a one way valve 20. This one way valve is in the form of a valve ball 21, as appears from FIG. 3, and arranged to be pressed against a valve seat 22 by a compression spring 23.

When mounting the one way valve 20 the valve ball 21 is placed in position in the valve seat 22 at one end of a drill rod 7, the compression spring 23 is applied externally thereof, a jointing sleeve 24 screwed onto the drill rod end, whereupon finally the end of another drill rod 7 is screwed into the jointing sleeve 24 until the drill rod ends abut against one another. The compression spring 23 is then compressed somewhat, whereby the valve ball 21 will abut against the valve 22 while exerting a certain pressure thereon.

In accordance with the invention it is suitable to position on the outside of the jointing sleeve 24, a seal 25, preferably consisting of hard rubber which upon application of a casing 8 about the jointing sleeve will abut sealingly against the inner face thereof.

During the drilling operation water will be flushed through the channels 13 in the direction of arrow 26, the water having a pressure exceeding the pressure with which the valve ball 21 presses against the valve seat 22. The stream of water will continue out through the channel arms 14, 15, 16, and 17 of the cutter head 9. Some water will flow out through the drill water opening 19 in the drill rod 7 and fill the space 27 existing between the drill rod 7 and the casing 8, which space is limited and closed by the double seal 10, 11 at one end and the seal 25 on the joint sleeve 24 at the opposite end. A positive pressure will exist in this space 27. This arrangement excludes every possibility of soil, sand, or water entering into the casing 8.

When it is time to joint drill rod sections 7 and casing sections 8, the cutter head 9 is stopped, and the drill water supply closed off. As a result the one way valve 20 will start functioning immediately, i.e. the spring 23 presses the ball 21 against the seat 22 which means that the drill water channel 13 ahead of the one way valve 20, as well as the channel arms 14, 15, 16, and 17 and the space 27 will be kept filled with water and thus constantly prevent ground water mixed with earth, sand, drill dust and other particles from entrance into the casing through these passageways. When the jointing operation is completed it is therefore possible to resume the drilling immediately without preliminary rinsing of the entire system.

Figure 4:
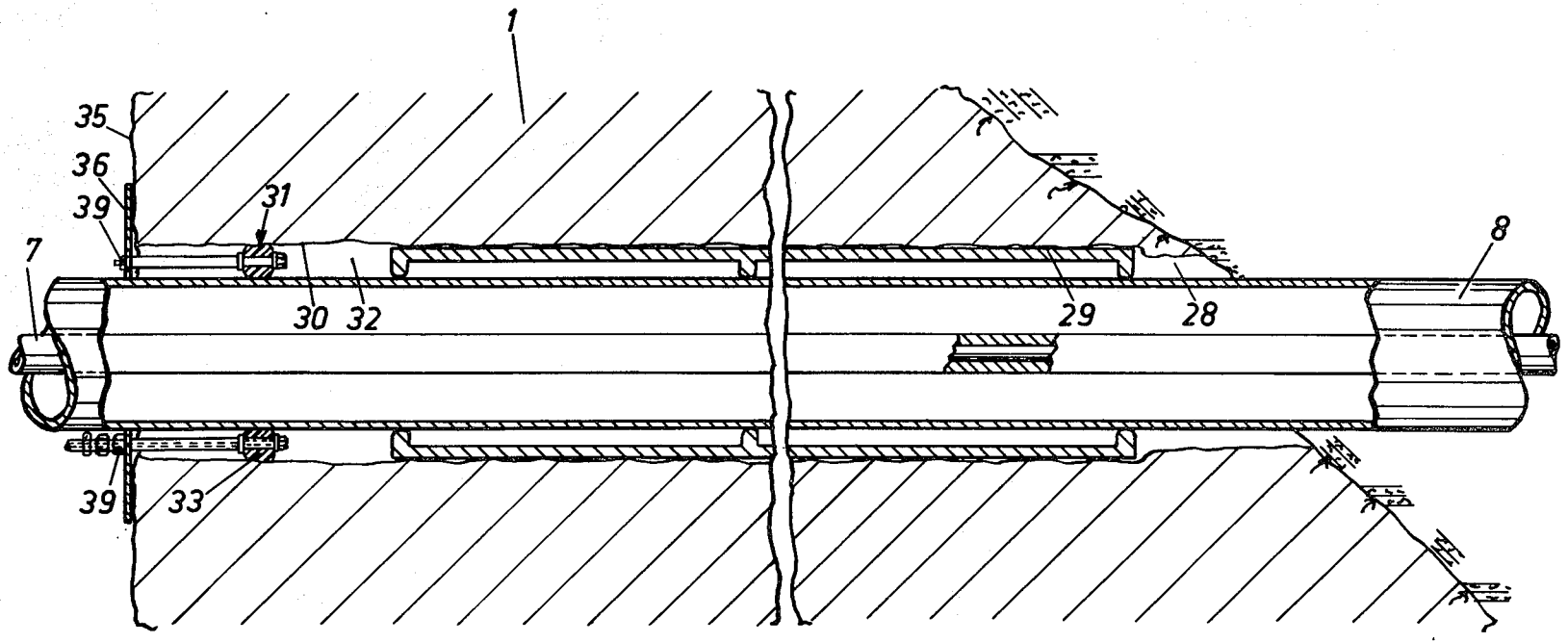
FIG. 4 is a vertical section through a casing provided with a pressure sleeve in accordance with the invention.
Figure 5:
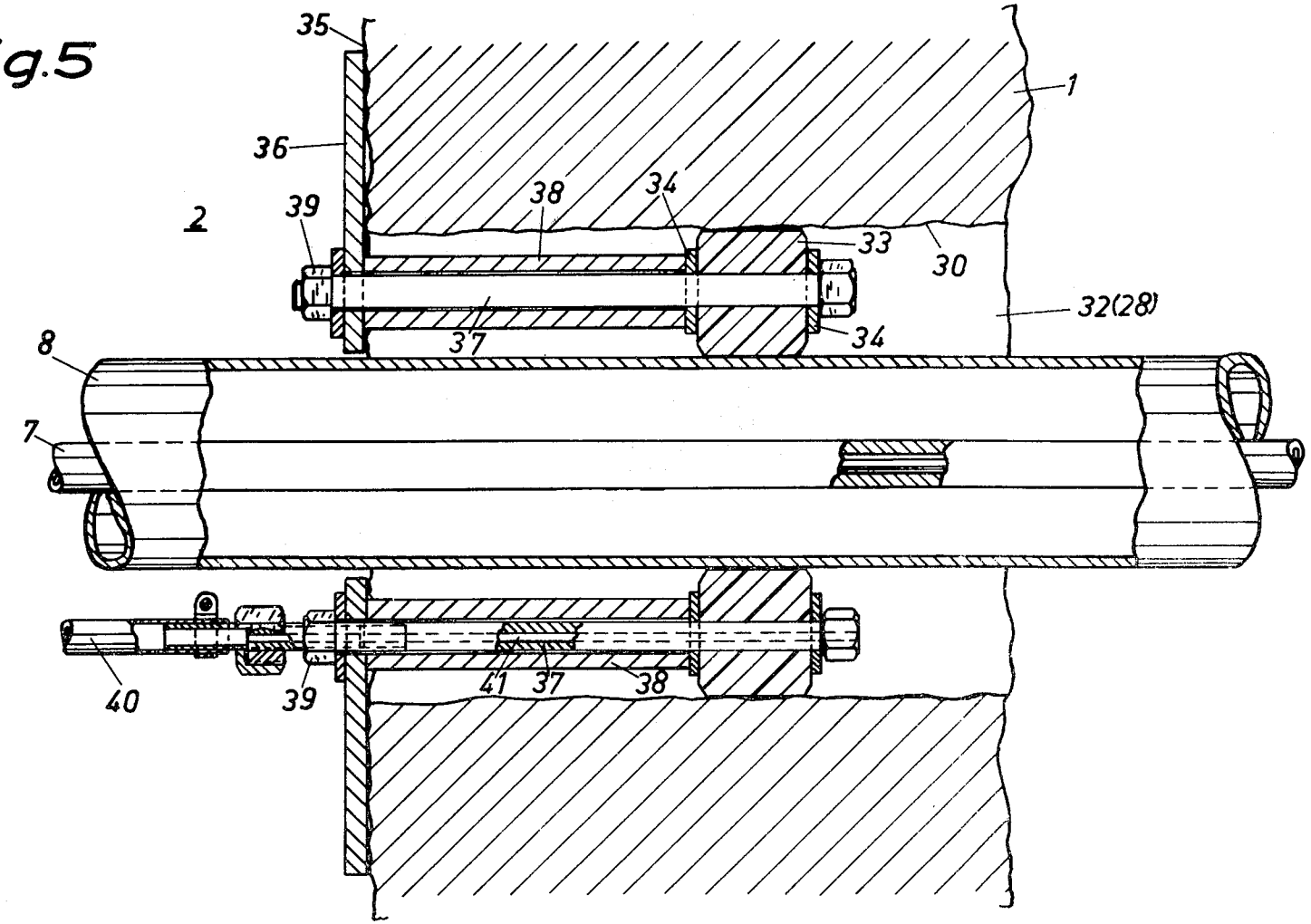
FIG. 5 is a vertical section through said pressure sleeve, shown on an enlarged scale.

In the bore opening 28 in the rock 1 is inserted concentrically about the casing 8 a guide tube 29 (see FIG. 4) serving to retain the direction of the casing at the casing exit from the rock. In accordance with the invention furthermore a pressure sleeve 31 is disposed between the casing 8 and the wall 30 of the drill opening 28, said sleeve 31 arranged to close the annular channel 32 formed between the casing and the walls of the drill hole.

In accordance with the embodiment illustrated in the drawings the pressure sleeve consists of an expansion ring 33 disposed between two clamping rings 34. An anchoring ring 26 abuts against the wall 35 of the drill chamber 2. Threaded bolts 37 pass through the expansion ring 33, the clamping rings 34, and the anchoring ring 36. Between the latter and the adjacent clamping ring 34 is arranged a distance sleeve 38 on each bolt 37.

When nuts 39 are tightened against the anchoring ring 36 the expansion ring 33 will swell out between the clamping rings 34, thus closing off the annular channel 32 from communciation with the drill chamber 2.

In accordance with the invention is furthermore provided a conduit means 40 supplying pressurized air or water and connected to the annular channel 32. In accordance with one embodiment of the invention one of the bolts 37 is then provided with a through channel 41 debouching into the annular channel, the conduit 40 communicating with this bolt.

By flushing water into the annular channel 32 at a pressure exceeding the pressure of the external ground water are efficiently prevented displacements of material in the strata of earth and the risk of subsidence therein is eliminated. As a consequence hereof it becomes easier to maintain the intended direction of drilling. The water thus forced into the channel also excludes formation of plugs in the annular channel 32 while at the same time serving as a lubricating means about the casing 8.

The invention is not limited to the embodiment as described and illustrated but may be constructively altered in a variety of ways within the scope of the appended claims. For instance, it is possible to attach the double seal against the inner face of the casing 8 instead of on the cutter head 9. Neither is there anything to prevent the seals 10 and 11 to change place, i.e. to position the rubber seal in the outer position and the metal seal in the inner position.

The one way valve 20, the structure of which is known per se, may of course be designed in a different manner and still fulfil its function in accordance with the inventive idea.

The hard rubber seal 25 need not be placed on the jointing sleeve 24 but may be attached about the drill rod 7 immediately behind the drill water opening 19. The space 27 thus becomes smaller and will be filled with water more rapidly.

Furthermore, other modifications of the pressure sleeve are possible, and the connection of the conduit 40 to the annular channel 32 may of course be through another means than a bolt 37.

It is also possible to inject into the annular channel 32 some medium other than water or air, e.g. some gas containing an ingredient which deposits on the rock walls and successively fills out crevices therein, thus preventing ground water from flowing into the annular channel.

What I claim is:

1. Improvements in drilling equipment for drilling from rocks into strata of earth and sand, said equipment comprising a drilling unit incorporating a cutter head, casing sections positioned between said drilling unit and said cutter head, and drill rod sections extending through said casing sections and having an axial through channel for the drilling water, the improvements comprising in combination, a first seal made from metal, a second seal made of some softer material, such as rubber or plastics, said seals positioned adjacent one another between said casing and said cutter head and arranged to cooperate for the purpose of preventing ground water and mud from penetrating into said casing, a one way valve arranged in the drill water channel in the drill rod positioned just behind said cutter head, said one way valve formed in a manner known per se by a valve ball, a compression spring arranged to press said valve ball against a valve seat, the drill rod positioned closest to said cutter head being provided adjacent said head with a drill water opening, a seal arranged behind said drill water opening and serving to prevent drill water from flowing between said drill rod and said casing in the direction towards said drill chamber, a pressure sleeve arranged between said casing and the wall of said drill hole, an annular channel formed between said casing and said wall of the drill hole, said pressure sleeve arranged to close off said annular channel against the drill chamber, and a conduit for supply of pressurized medium, such as air or water, said conduit debouching into said annular channel.

2. Improvements in accordance with claim 1, wherein said metal seal is a hard-welding bead applied about said cutter head.

3. Improvements in accordance with claim 1, wherein said softer seal is made from hard rubber, the improvements comprising a peripheral groove formed in said cutter head, said softer seal vulcanized to said groove.

4. Improvements in accordance with claim 1, the improvements comprising a jointing sleeve interconnecting two drill rod sections, said seal positioned behind said drill water opening mounted on said jointing sleeve.

5. Improvements in accordance with claim 1, the improvements comprising an expansion ring forming said pressure sleeve, two clamping rings between which is mounted said expansion ring, threaded bolts passing through said expansion ring, an anchoring ring abutting against the wall of said drill chamber about the bore hole mouth said bolts also passing through said anchoring ring, and a distance sleeve on each one of said bolts, said distance sleeve arranged between said anchoring ring and the adjacent one of said clamping rings.

6. Improvements in accordance with claim 5, the improvements comprising a through channel in at least one of said bolts, said conduit for supply of pressurized medium arranged to be communicated to said through channel.

* * * * *